US009206711B2

(12) United States Patent
Fujii et al.

(10) Patent No.: US 9,206,711 B2
(45) Date of Patent: Dec. 8, 2015

(54) LASH ADJUSTER

(71) Applicant: OTICS CORPORATION, Nishio-shi, Aichi (JP)

(72) Inventors: Hiroki Fujii, Aichi (JP); Kimihiko Todo, Aichi (JP)

(73) Assignee: OTICS CORPORATION, Nishio-Shi, Aichi (JP)

( * ) Notice: Subject to any disclaimer, the term of this patent is extended or adjusted under 35 U.S.C. 154(b) by 2 days.

(21) Appl. No.: 14/175,641

(22) Filed: Feb. 7, 2014

(65) Prior Publication Data

US 2014/0230766 A1 Aug. 21, 2014

(30) Foreign Application Priority Data

Feb. 15, 2013 (JP) ..... 2013-027979

(51) Int. Cl.
*F01L 1/18* (2006.01)
*F01L 1/24* (2006.01)

(52) U.S. Cl.
CPC . *F01L 1/24* (2013.01); *F01L 1/185* (2013.01); *F01L 1/2405* (2013.01)

(58) Field of Classification Search
CPC ..... F01L 1/2405; F01L 13/0005; F01L 1/24
USPC ..... 123/90.46
See application file for complete search history.

(56) References Cited

U.S. PATENT DOCUMENTS 5,509,385 A 4/1996 LaVieri
5,706,773 A 1/1998 Dura et al.
5,979,377 A 11/1999 Barth et al.
2005/0178351 A1 * 8/2005 Mayer et al. ..... 123/90.48
2012/0042843 A1 * 2/2012 Kubota et al. ..... 123/90.55

(Continued)

FOREIGN PATENT DOCUMENTS

DE 2343269 3/1975
DE 19614668 A1 10/1997

(Continued)

OTHER PUBLICATIONS

May 204 generated European Search Report for EP Application No. 14 00 0223.

(Continued)

*Primary Examiner* — Jesse Bogue
*Assistant Examiner* — Daniel Bernstein
(74) *Attorney, Agent, or Firm* — Smith, Gambrell & Russell, LLP.

(57) ABSTRACT

A lash adjuster includes a body, a plunger inserted into the body and having a bottom wall with a valve hole and a peripheral wall having an oil passage hole, and a partitioning member. The partitioning member is inserted into the plunger and has an oil passage end located above the oil passage hole in an inserted state. The partitioning member has a recess defining an oil passage together with the peripheral wall. The partitioning member defines a low-pressure chamber reserving hydraulic fluid and has, together with the recess, a press-fit portion abutting against an inner periphery of the peripheral wall when the partitioning member is inserted into the plunger. Consequently, the partitioning member has a deformed cross-sectional shape except for a circular shape when cut at a same height as the oil passage hole. The partitioning member has a same cross-sectional shape over its entire height.

3 Claims, 6 Drawing Sheets

(56) References Cited

U.S. PATENT DOCUMENTS

| | | | | |
|---|---|---|---|---|
| 2012/0279386 | A1 * | 11/2012 | Christgen et al. | 91/169 |
| 2014/0224201 | A1 | 8/2014 | Oka et al. | |
| 2014/0224202 | A1 | 8/2014 | Suzuki et al. | |
| 2014/0230767 | A1 | 8/2014 | Yamamoto et al. | |
| 2014/0230768 | A1 | 8/2014 | Haga et al. | |

FOREIGN PATENT DOCUMENTS

| | | | |
|---|---|---|---|
| DE | 10 2005 025 765 | | 12/2006 |
| DE | 10 2006 007 375 | | 8/2007 |
| DE | 10 2006 007 376 | | 8/2007 |
| DE | 10 2006 004751 | A1 | 8/2007 |
| DE | 102006004751 | A1 * | 8/2007 |
| DE | 10 2006 017442 | A1 | 10/2007 |
| EP | 1564383 | | 8/2005 |
| JP | 57181908 | | 11/1982 |
| JP | 61118509 | | 6/1986 |
| JP | 06-37504 | | 5/1994 |
| JP | 05-288019 | | 11/2003 |
| JP | 2004-197665 | | 7/2004 |
| JP | 2008-064020 | | 3/2008 |
| WO | 9215776 | A1 | 9/1992 |
| WO | 2007/118820 | A1 | 10/2007 |
| WO | WO 2007118820 | A1 * | 10/2007 |

OTHER PUBLICATIONS

European Search Report corresponding to co-pending EP application No. 14000213.0 dated Apr. 22, 2014, listed in IDS for U.S. Appl. No. 14/175,560.

European Search Report corresponding to co-pending EP application No. 14000198.3 dated Apr. 14, 2014, listed in IDS for U.S. Appl. No. 14/175,610.

May 15, 2014 generated European Search Report for EP Application No. 14000227, listed in IDS for U.S. Appl. No. 14/175,653.

European Search Report corresponding to co-pending EP application No. 14000199.1 dated Apr. 22, 2014, listed in IDS for U.S. Appl. No. 14/175,670.

* cited by examiner

LASH ADJUSTER

CROSS-REFERENCE TO RELATED APPLICATIONS

This application is based upon and claims the benefit of priority from the prior Japanese Patent Application No. 2013-27979 filed on Feb. 15, 2013, the entire contents of which are incorporated herein by reference.

BACKGROUND

1. Technical Field

The present invention relates to a lash adjuster.

2. Related Art

A conventional lash adjuster includes a bottomed cylindrical body fixed to a cylinder head of an internal combustion engine and a plunger which is inserted into the body so that the plunger is movable up and down. The plunger has an upper end supporting a rocker arm. The plunger further has a peripheral wall formed with an oil passage hole and a bottom wall formed with a valve hole. Hydraulic fluid, such as oil, supplied through an oil filler hole of the cylinder head is stored in a low-pressure chamber in the plunger through the oil passage hole and also supplied through the valve hole into the body thereby to fill the body. A high-pressure chamber is defined by dividing an interior of the body by the bottom wall of the plunger. The plunger is moved up and down according to oil pressure in the high-pressure chamber. The hydraulic fluid in the low-pressure chamber in the plunger is drawn through the valve hole into the high-pressure chamber when the plunger is moved upward. In this case, there is a possibility that air entrainment may occur in the high-pressure chamber when the hydraulic fluid level is low in the low-pressure chamber.

In view of the aforementioned problem, the conventional art provides a lash adjuster provided with a cylindrical partitioning member inserted into the plunger. A space inside the partitioning member serves as a low-pressure chamber. An oil passage is formed between an inner periphery of the plunger and an outer periphery of the partitioning member. An oil passage end is located above the oil passage hole. As a result, a large amount of hydraulic fluid is supplied from the oil passage hole via the oil passage and the oil passage end into the low-pressure chamber. Since the hydraulic fluid level depends upon the oil passage end located above the oil passage hole, air entrainment can be prevented in the high-pressure chamber.

The oil passage is defined over an entire circumference of the partitioning member in the above-described conventional lash adjuster. This results in a problem that the hydraulic fluid has a high pressure loss when passing through the oil passage. When a radial passage width of the oil passage is increased for the purpose of improving a flow speed of hydraulic fluid, an inner diameter of the partitioning member is reduced in inverse proportion to the increase in the passage width. This results in a problem that a sufficient amount of hydraulic fluid cannot be ensured in the low-pressure chamber.

SUMMARY

Therefore, an object of the invention is to provide a lash adjuster which can reduce pressure loss of hydraulic fluid and can ensure a sufficient amount of hydraulic fluid in the low-pressure chamber.

The invention provides a lash adjuster including a body formed into a bottomed cylindrical shape, a plunger which is inserted into the body so as to be movable up and down and has a bottom wall formed with a valve hole and a peripheral wall standing from an outer periphery of the bottom wall and having an oil passage hole formed therethrough, so that the plunger is formed into a bottomed cylindrical shape, the plunger defining a high-pressure chamber between the bottom wall and the body, and a partitioning member having a tubular shape and inserted into the plunger, the partitioning member having an oil passage end located above the oil passage hole in an inserted state, the partitioning member having a recess defining an oil passage together with the peripheral wall of the plunger therebetween, the partitioning member defining thereinside a low-pressure chamber reserving hydraulic fluid flowing thereinto through the oil passage hole, the oil passage and the oil passage end and causing the hydraulic fluid to flow through the valve hole into the high-pressure chamber. In the lash adjuster, the partitioning member has, together with the recess, a press-fit portion which abuts against an inner periphery of the peripheral wall of the plunger when the partitioning member is inserted into the plunger, so that the partitioning member has a deformed cross-sectional shape except for a circular shape when the partitioning member is cut at a same height as the oil passage hole. The partitioning member has a same cross-sectional shape over an entire height thereof.

In the above-described construction, in the inserted state of the partitioning member, the oil passage is defined by the recess of the partitioning member at a same height as the oil passage hole of the plunger. Furthermore, the press-fit portion of the partitioning member abuts against the peripheral of the plunger. Accordingly, the above-described construction can increase an inner volume of the low-pressure chamber as compared with the case where the oil passage is defined between the plunger and the partitioning member over an entire circumference of the partitioning member. In addition, the above-described construction can reduce pressure loss of the hydraulic fluid passing through the oil passage.

DETAILED DESCRIPTION

Figure 1:
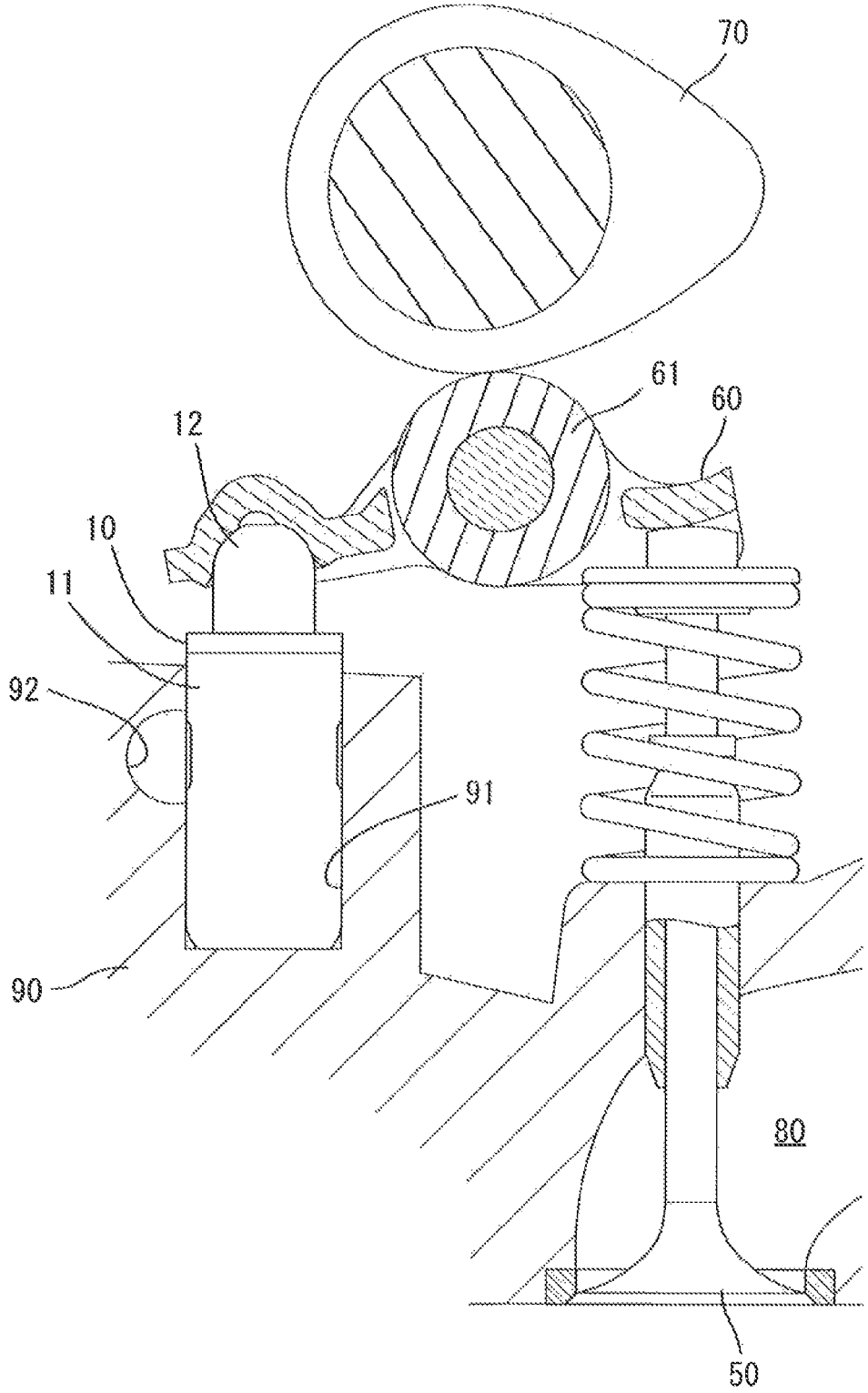
FIG. 1 is a schematic sectional view of an internal combustion engine in which a lash adjuster in accordance with one embodiment is incorporated.

Embodiment 1 of the present invention will be described with reference to FIGS. 1 to 3 of the accompanying drawings. Referring to FIG. 1, a lash adjuster 10 in accordance with embodiment 1 is shown. As shown, the lash adjuster 10 is incorporated in a valve gear of an internal combustion engine. The valve gear includes a valve 50, a rocker arm 50 and a cam 70 in addition to the lash adjuster 10.

The lash adjuster 10 is inserted into a mounting recess 91 of a cylinder head 90 from above. The valve 50 is provided to be capable of opening and closing an intake/exhaust port 80 of the cylinder head 90. The rocker arm 60 is disposed so as to extend between an upper end (a support portion 25 of a plunger 12 as will be described later) of the lash adjuster 10 and an upper end of the valve 50 in a right-left direction. The cam 70 is disposed above the rocker arm 60 so as to be slidable together with a roller 61 of the rocker arm 60. Upon rotation of the cam 70, the rocker arm 60 is swung in an up-down direction with the upper end of the lash adjuster 10 serving as a fulcrum. With swing of the rocker arm 60, the valve 50 is moved up and down thereby to open and close the intake/exhaust port 80.

The lash adjuster 10 will now be described more concretely. The lash adjuster 10 includes a body 11, a plunger 12 and a partitioning member 13 as shown in FIG. 2. The body 11 has a disc-shaped bottom wall 14 and a cylindrical peripheral wall 15 standing from an outer periphery of the bottom wall 14. The body 11 is formed into a bottomed cylindrical shape as a whole. The body 11 is fittable into the mounting recess 91 of the cylinder head 90. The peripheral wall 15 of the body 11 has an outer oil passage hole 16 formed therethrough. The outer oil passage hole 16 is disposed in communication with an oil filler hole 92 of the cylinder head 90. Furthermore, the body 11 has an outer periphery formed with an annular recess 17 which extends over the entire periphery thereof and in which the outer oil passage hole 15 is open. Accordingly, the outer oil passage hole 16 and the oil filler hole 92 are retained in communication via the annular recess 17 even when the body 11 is rotated in the mounting recess 91.

The plunger 12 has a disc-shaped bottom wall 18 and a cylindrical peripheral wall 19 standing from an outer periphery of the bottom wall 18 and is formed into a bottomed cylindrical-shape as a whole. The bottom wall 18 includes a central part through which a valve hole 20 is formed. The valve hole 20 communicates between a high-pressure chamber 22 and a low-pressure chamber 23 via a valve element 21 as will be described later. The peripheral wall 19 has an upper end formed with a semispherical support portion 25 which is radially squeezed and has a centrally located through hole 24. The support portion 25 includes an outer semispherical surface on which a rocker arm 60 is adapted to slide during swinging. The peripheral wall 19 is also formed with an oil passage hole 26. The peripheral wall 19 has an outer periphery formed with an annular recess 27 which extends over the whole periphery thereof and in which the oil passage hole 26 is open. The oil passage hole 26 communicates with the outer oil passage hole 16 of the body 11 via the annular recess 27, and the oil passage hole 26 and the outer oil passage hole 16 are retained in communication even when the plunger 12 is rotated in the body 11.

Figure 2:
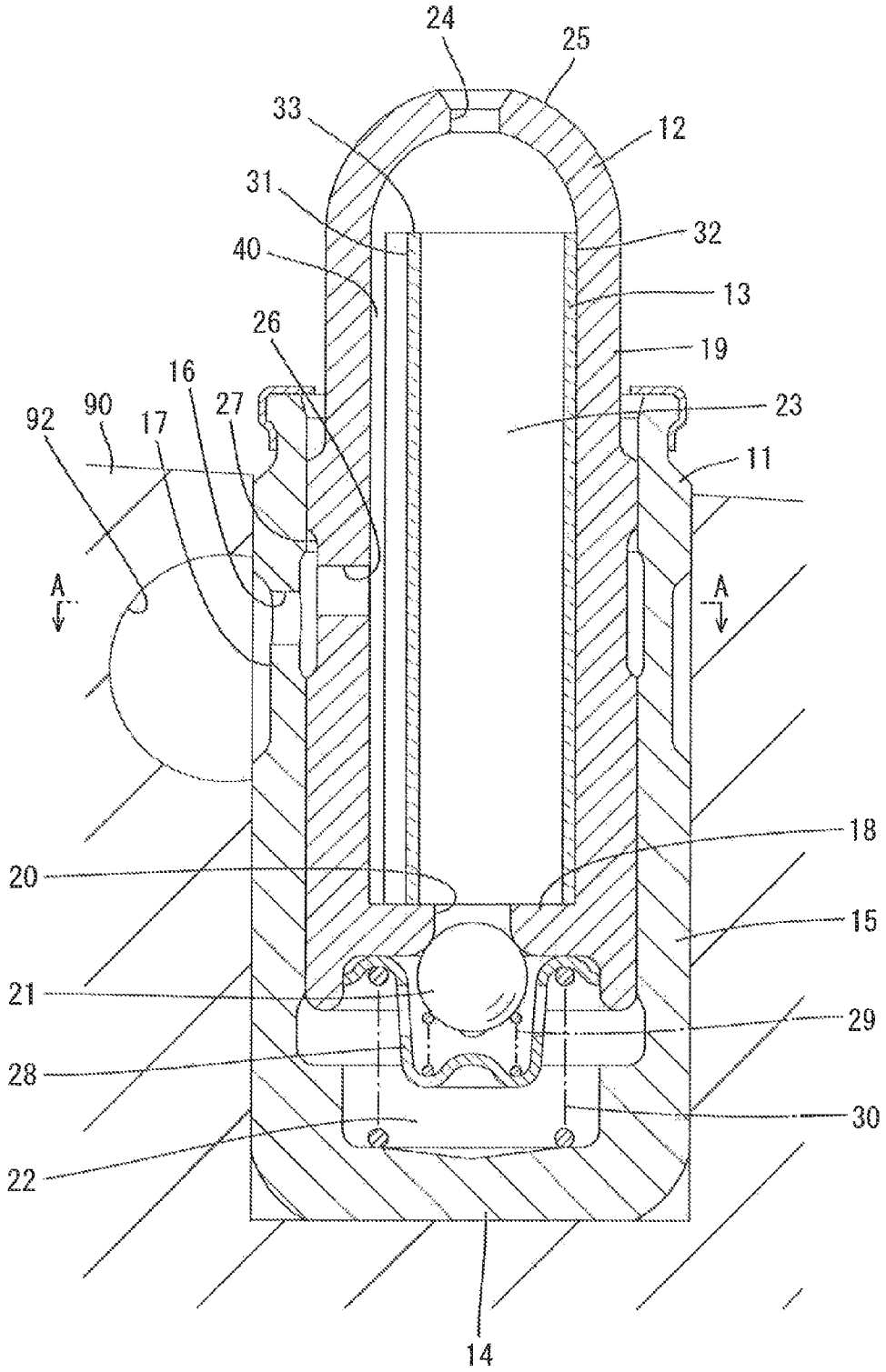
FIG. 2 is a sectional view of the lash adjuster.
Figure 3:
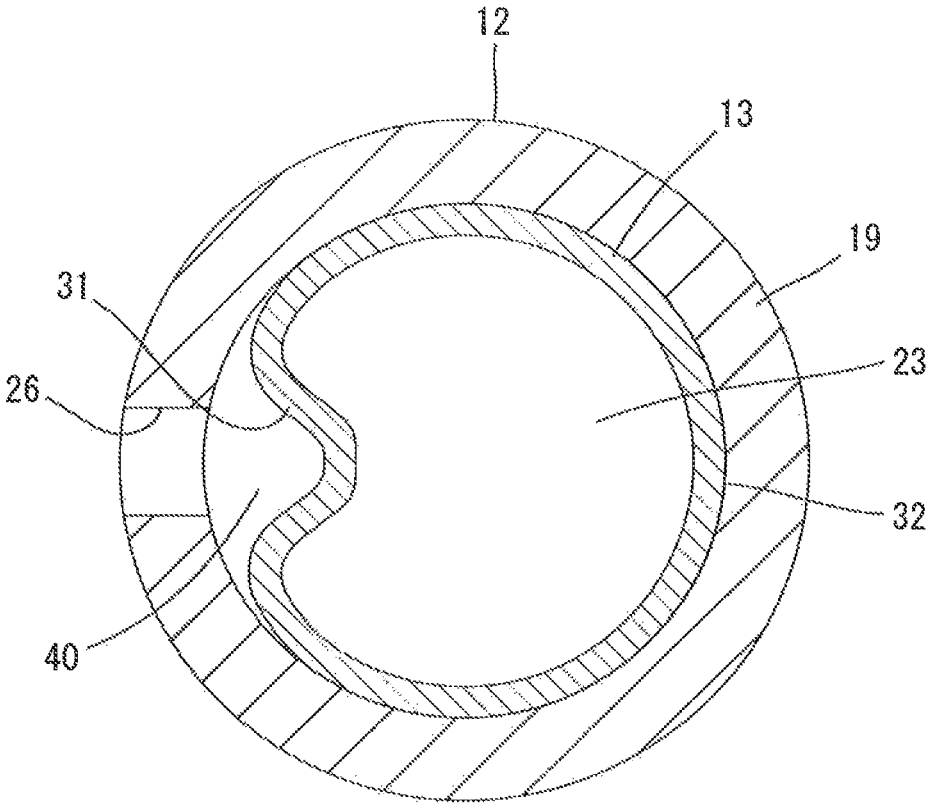
FIG. 3 is a sectional view taken along line A-A in FIG. 2.

The high-pressure chamber 22 is defined between the bottom wall 18 of the plunger 12 and the body 11 when the plunger 12 is inserted into the body 11, as shown in FIG. 2. A spherical valve element 21 is provided in the high-pressure chamber 22. The valve element 21 is housed in a cage-like retainer 28 and biased by a first spring 29 in a direction such that the valve hole 20 is closed. The high-pressure chamber 22 is also provided with a second spring 30 located between the bottom wall 14 of the body 11 and an upper edge of the retainer 28. The plunger 12 is biased upward by the second spring 30.

The partitioning member 13 is inserted into the plunger 12 to be fixed in position. The partitioning member 13 is a metallic tubular body and is formed as a whole into the shape of a cylinder extending in the up-down direction. The partitioning member 13 is disposed so that a lower end thereof is in abutment with the bottom wall 18 of the plunger 12 and so that an upper end of the partitioning member 13 is located near the support portion 25 of the plunger 12 above the oil passage hole 26 when the partitioning member 13 is inserted into the plunger 12. In embodiment 1, the partitioning member 13 has a deformed cross-sectional shape except for a circular shape over an entire height thereof (an entire vertical dimension thereof). More specifically, the partitioning member 13 has a recess 31 which is concave in a direction such that the recess 31 departs from the oil passage hole 26 of the plunger 12 when cut at a same height as the of passage hole 26 in an inserted state, as shown in FIG. 3. In addition, the partitioning member 13 has a press-fit portion 32 abuttable against the inner periphery of the peripheral wall 19 of the plunger 12. The press-fit portion 32 has the shape of an arc that is equal to or larger than a semiperimeter and is continuous with both circumferential ends of the recess 31 so that continuous parts of the press-fit portion 32 are curved. The partitioning member 13 includes a part except for the recess 31, which part constitutes the press-fit portion 32. Both recess 31 and press-fit portion 32 are formed over an entire height (or a vertical dimension) of the partitioning member 13 as shown in FIG. 2.

The recess 31 is formed into the bent shape by striking a cylindrical tube body from the outside. The partitioning member 13 is passed through an upper open end of the plunger 12 which has not been formed with the support portion 25 and then inserted in a press-fit state via the press-fit portion 32 into the plunger 12. After the partitioning member 13 has been inserted into the plunger 12, an upper end of the plunger 12 is squeezed in a diameter-reducing direction, so that the support portion 25 is formed together with a through hole 24.

An oil passage 40 is defined between the recess 31 of the partitioning member 13 and the peripheral wall 19 of the plunger 12 so as to extend in an up-down direction in the interior of the plunger 12. The partitioning member 13 has an upper end constituting an oil passage end 33. An upper end of the oil passage 40 faces the upper end of the partitioning member 13. A part defined inside the partitioning member 13 in the interior of the plunger 12 serves as a low-pressure chamber 23.

The hydraulic fluid, flowing through the oil filler hole 92 of the cylinder bead 90 is supplied sequentially through the outer oil passage hole 16, the oil passage hole 26, the oil passage 40 and the oil passage end 33 to be reserved in the low-pressure chamber 23. The hydraulic fluid reserved in the low-pressure chamber 23 is further supplied through the valve hole 20 to fill the high-pressure chamber 22. In this case, since the oil passage end 33 is located above the oil passage hole 26, the hydraulic fluid is reserved in the low-pressure chamber 23 to a level above the oil passage hole 26.

The valve element 21 closes the valve hole 20 thereby to close the high-pressure chamber 22 when a downward pressure is applied from the rocker arm 60 side to the plunger 12 in the state where the hydraulic fluid has been introduced into the low-pressure chamber 23 and the high-pressure chamber 22. As a result, the plunger 12 is stopped lowering by the hydraulic pressure of the high-pressure chamber 22. On the other hand, when the plunger 12 is raised with decrease in the pressure from the rocker arm 60 side, the capacity of the high-pressure chamber 22 is increased. When the capacity of the high-pressure chamber 22 is increased, the valve element 21 is lowered thereby to open the valve hole 20. As a result, the hydraulic fluid in the low-pressure chamber 23 flows through the valve hole 20 into the high-pressure chamber 22 thereby to fill the high-pressure chamber 22. Upon stop of the upward movement of the plunger 12, the valve element 21 is biased by the first spring 29 thereby to be moved upward and close the valve hole 20, so that the high-pressure chamber 22 is closed. Thus, the plunger 12 is moved up and down relative to the body 11, whereby the support position of the plunger 12 relative to the rocker arm 60 fluctuates with the result that a valve clearance is adjusted.

In the foregoing embodiment, the recess 31 is formed in a circumferential part of the partitioning member 13. The oil passage 40 is defined between the recess 31 and the peripheral wall 19 of the plunger 12. Accordingly, a pipe friction resistance of the hydraulic fluid passing through the oil passage 40 can be reduced in the foregoing embodiment as compared with the conventional construction in which the oil passage is formed over the entire circumference of the inside of the plunger 12, with the result that the pressure loss can be reduced significantly.

Furthermore, with the recess 31 formed in one circumferential part of the partitioning member 13, the press-fit portion 32 is formed in the other circumferential part of the partitioning member 13 and is in abutment with the peripheral wall 19 of the plunger 12. As a result, the low-pressure chamber 23 defined inside the partitioning member can ensure a sufficient inner volume. Moreover, the partitioning member 13 has a deformed cross-sectional shape except for a circular shape over an entire height thereof. This improves the stiffness of the partitioning member 13, preventing deformation of the partitioning member 13 in press fit into the plunger 12.

Furthermore, since the press-fit portion 32 is formed in the entire circumferential part of the partitioning member 13 except for the part of the recess 31, the partitioning member 13 is fixed via the press-fit portion 32 to the plunger 12 stably and rigidly.

Figure 4:
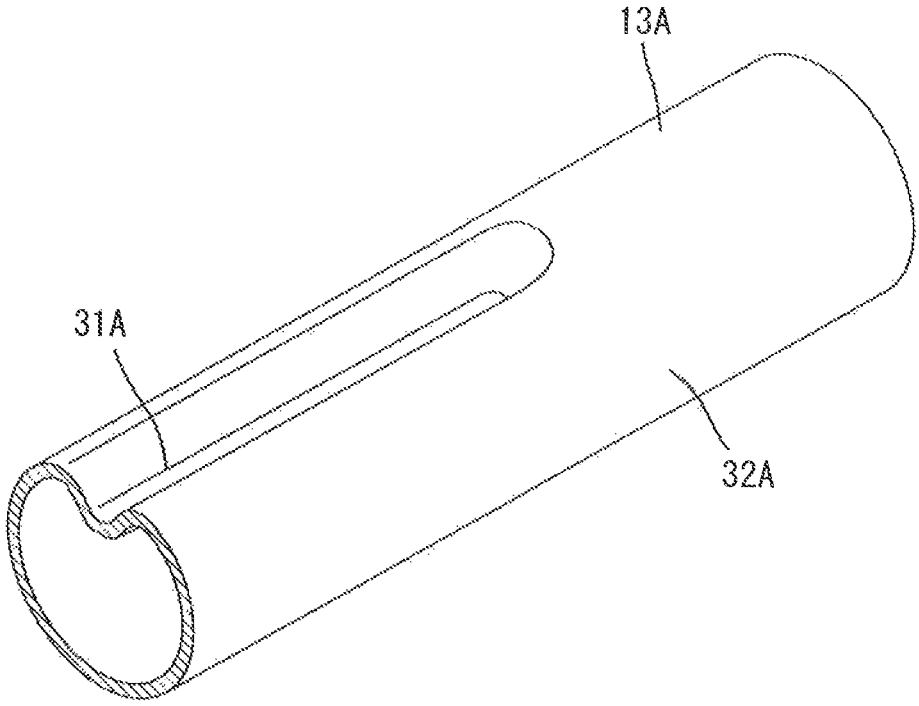
FIG. 4 is a perspective view of a partitioning member employed in the lash adjuster in accordance with a reference example.

FIG. 4 illustrates a reference example. The reference example differs from embodiment 1 in the structure of the partitioning member 13A and is identical with embodiment 1 in other respects.

The partitioning member 13A includes an upper part and a lower part with a boundary being located midway in the up-down direction (the right side is an upper side as viewed in FIG. 4). The upper part is formed with both recess 31A and press-fit portion 32A while the lower part is formed with only the press-fit portion 32A. The upper and lower parts of the partitioning member 13A have different sectional shapes. The upper part of the partitioning member 13A has the same deformed cross-sectional shape except for the circular shape as the partitioning member 13 in embodiment 1. The recess 31A of the upper part extends from a location opposed to the oil passage hole 26 to the upper end (an oil passage end 33) in the state where the partitioning member 13A is inserted in the plunger 12. The lower part of the partitioning member 13A serves as the press-fit portion 32A which has a circular section and is abuttable on an entire inner circumference of the peripheral wall 19 of the plunger 12 in the inserted state of the partitioning member 13A in the plunger 12.

According to the reference example, the recess 31A is provided in the minimum required part of the partitioning member 13A. This can reduce pressure loss of the hydraulic fluid flowing through the oil passage 40. Moreover, since the press-fit portion 32A is formed over an entire circumference of the lower part of the partitioning member 13A, the stability of the fixed state of the partitioning member 13A can be improved.

Figure 5:
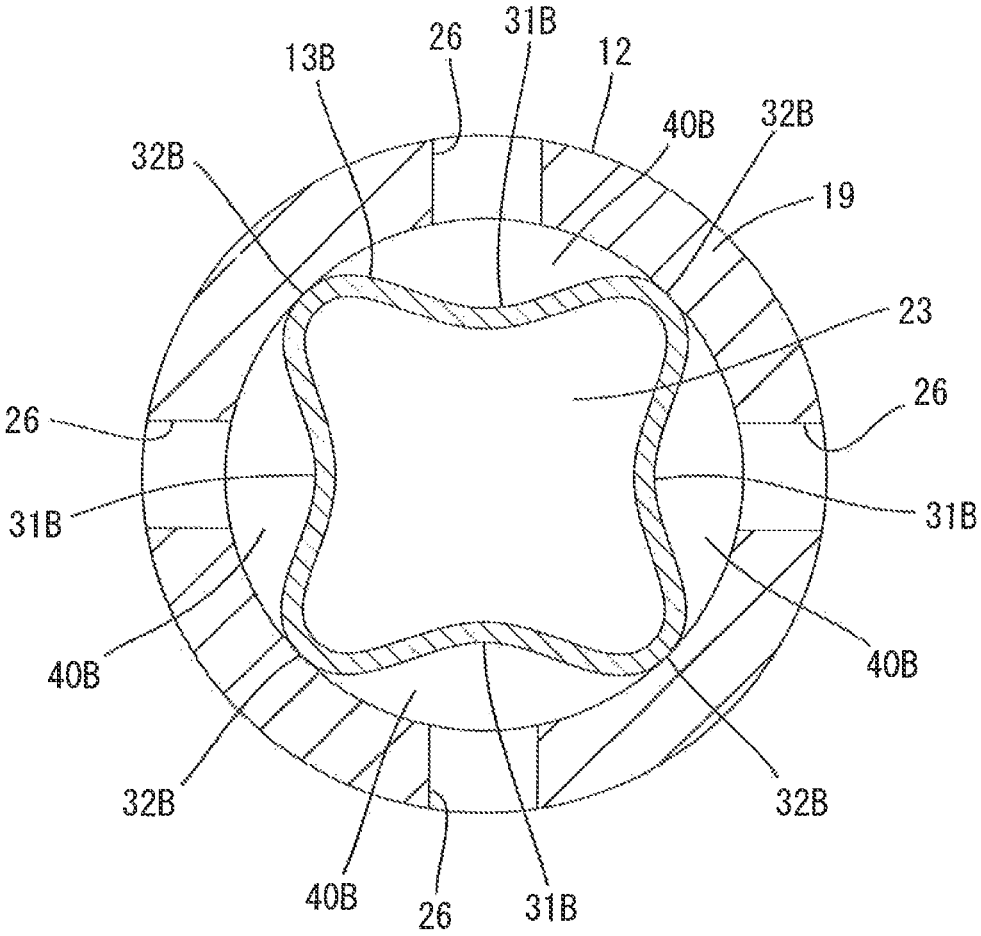
FIG. 5 is a view similar to FIG. 3, showing the lash adjuster in accordance with embodiment 2.

FIG. 5 illustrates embodiment 2. Embodiment 2 differs from embodiment 1 in the structure of the partitioning member 13B and the location of the oil passage hole 26 and is identical with embodiment 1 in other respects.

A plurality of oil passage holes 26 is formed in the peripheral wall 19 of the plunger 12 and more specifically, four oil passage holes 26 are formed in the peripheral wall 19 circumferentially at regular intervals. The partitioning member 13B has four recesses 31B opposed to the oil passage holes 26 with oil passages 40 being located therebetween in the inserted state thereof in the plunger 12, respectively. The partitioning member 13B also has four press-fit portions 32B which are disposed between recesses 31B with respect to the circumferential direction so as to be abuttable on the inner circumference of the peripheral wall 19 of the plunger 12 in the inserted state of the partitioning member 13B in the plunger 12. More specifically, the partitioning member 13B has the radially concaved recesses 31B at four circumferentially equally spaced locations respectively and the four press-fit portions 32B located between the concaved portions 31B and protruding radially from the recesses 31B. The partitioning member 13B is symmetric about an axis thereof as a whole. In this case, the hydraulic fluid is supplied through the oil passage holes 26 into the corresponding oil passages 40B respectively. The hydraulic fluid flowing through the oil passages 40B then fills the low-pressure chamber 23 and the high-pressure chamber 22.

According to embodiment 2, since the partitioning member 13B is symmetric about the axis, the partitioning member 13B can be identified in the circumferential direction more easily with the result that handling properties of the lash adjuster can be improved.

Figure 6:
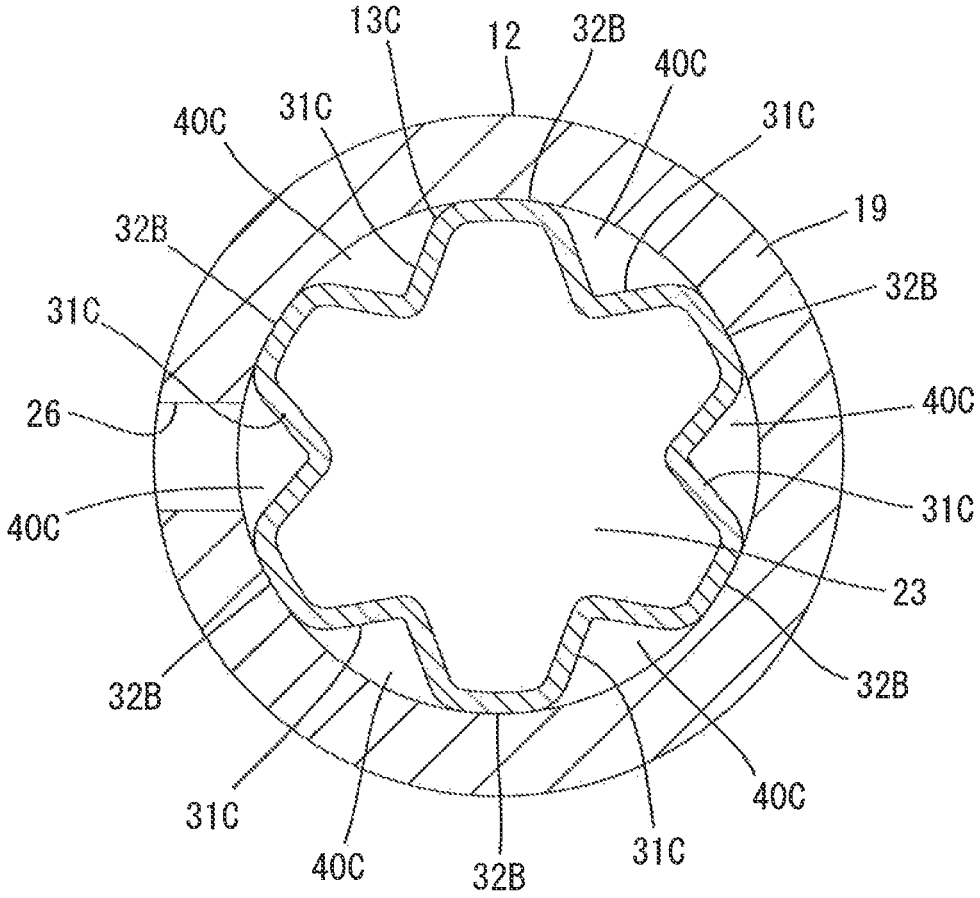
FIG. 6 is a view similar to FIG. 3, showing the lash adjuster in accordance with embodiment 3.

FIG. 6 illustrates embodiment 3. Embodiment 3 differs from embodiment 1 in the structure of the partitioning member 13C and is identical with embodiment 1 in other respects.

The partitioning member 13C has six radially concaved recesses 31C arranged circumferentially at regular intervals and six press-fit portions 32B located between the recesses 31C and protruding radially from the recesses 31C. The partitioning member 13C is symmetric about an axis thereof as a whole. When the partitioning member 13C is inserted into the plunger 12, one of the recesses 31C is disposed opposite the oil passage hole 26 of the plunger 12 with the oil passage 40C being located therebetween. The press-fit portions 32B are disposed so as to be abuttable on the inner periphery of the peripheral wall 19 of the plunger 12. Embodiment 3 can render circumferential identification of the partitioning member 13C easier.

The invention should not be limited to the foregoing embodiments 1 to 3 and the following embodiments are included in the technical scope of the invention.

(1) The oil passage end may be formed into the shape of an cutout in the upper end of the partitioning member.

(2) The upper end of the partitioning member may be squeezed radially so as to correspond to a semispherical shape of the support portion.

(3) The press-fit portion may be provided on a heightwise part of the partitioning member.

(4) As the reference example is applied to embodiment 1, the reference example may be applied to each of embodiments 2 and 3, so that both recesses and press-fit portions may be provided in the upper part of the partitioning member and only the press-fit portions may be provided in the lower part of the partitioning member.

(5) The press-fit portion/portions may be shrinkage-fitted into the plunger.

What is claimed is:

1. A lash adjuster comprising:

a body formed into a bottomed cylindrical shape;

a plunger which is inserted into the body so as to be movable up and down and has a bottom wall formed with a valve hole and a peripheral wall standing from an outer periphery of the bottom wall and having an oil passage hole formed therethrough, so that the plunger is formed into a bottomed cylindrical shape, the plunger defining a high-pressure chamber between the bottom wall and the body; and a partitioning member having a tubular shape and inserted into the plunger, the partitioning member having an oil passage end located above the oil passage hole in an inserted state, the partitioning member having a recess defining an oil passage together with the peripheral wall of the plunger therebetween, the partitioning member defining thereinside a low-pressure chamber reserving hydraulic fluid flowing thereinto through the oil passage hole, the oil passage and the oil passage end and causing the hydraulic fluid to flow through the valve hole into the high-pressure chamber, wherein the partitioning member has, together with the recess, a press-fit portion which abuts against an inner periphery of the peripheral wall of the plunger when the partitioning member is inserted into the plunger, so that the partitioning member has a deformed cross-sectional shape except for a circular shape when the partitioning member is cut at a same height as the oil passage hole, and wherein the partitioning member has a same cross-sectional shape over an entire height thereof.

2. The lash adjuster according to claim 1, wherein the press-fit portion is continuous with both circumferential ends of the recess so that continuous parts of the press-fit portion are curved.

3. The lash adjuster according to claim 1, wherein the press-fit portion extends over an entire part of the partitioning member except for the recess.

* * * * *